US005501374A

United States Patent [19]

Laufer et al.

[11] Patent Number: 5,501,374

[45] Date of Patent: Mar. 26, 1996

[54] DEVICE FOR EXTRUDING HIGH VISCOSITY FLUID HAVING MULTIPLE MODES OF OPERATION

[75] Inventors: William C. Laufer, Cleveland; Richard C. Weiner, North Olmsted; Stipe Vranic, Middleburg Heights, all of Ohio

[73] Assignee: Vital Products, Co., Cleveland, Ohio

[21] Appl. No.: 261,479

[22] Filed: Jun. 17, 1994

[51] Int. Cl.[6] ..... B67D 5/42

[52] U.S. Cl. ..... 222/391; 74/155

[58] Field of Search ..... 222/391, 326, 222/327; 74/155

[56] References Cited

U.S. PATENT DOCUMENTS

| | | | |
|---|---|---|---|
| 1,013,454 | 1/1912 | Sherbondy . | |
| 1,672,421 | 6/1928 | Negley | 222/391 |
| 1,846,167 | 2/1932 | Wallen | 222/391 |
| 2,180,978 | 11/1939 | Crewe | 74/169 |
| 2,229,839 | 1/1941 | Crewe | 74/169 |
| 2,233,587 | 3/1941 | Crewe | 74/169 |
| 2,367,346 | 1/1945 | Good | 74/169 |
| 2,367,347 | 1/1945 | Good | 74/169 |
| 2,530,359 | 11/1950 | Peterson | 222/327 |
| 2,889,085 | 6/1959 | Collins | 222/391 |
| 4,126,251 | 11/1978 | Subwick | 222/326 |
| 4,356,938 | 11/1982 | Kayser | 222/327 |
| 4,526,303 | 7/1985 | Harrod | 222/386.5 |
| 4,994,065 | 2/1991 | Gibbs et al. | 606/92 |

FOREIGN PATENT DOCUMENTS

| | | | |
|---|---|---|---|
| 905049 | 9/1962 | United Kingdom | 222/391 |

*Primary Examiner*—Gregory L. Huson
*Attorney, Agent, or Firm*—Rankin, Hill, Lewis & Clark

[57] ABSTRACT

A device for extruding high viscosity fluids is described which has multiple modes of operation and provides a mechanism for relieving pressure being applied to fluid being extruded. The pressure release mechanism includes a first and second dog and a release arm that engages the second dog to result in the second dog disengaging the teeth of a drive rod attached to a piston for applying pressure to the fluid material to be extruded resulting in relief of the applied pressure by the drive rod and piston combination to stop the flow of the fluid from the nozzle of the device. The preferred device is a caulking gun.

8 Claims, 3 Drawing Sheets

DEVICE FOR EXTRUDING HIGH VISCOSITY FLUID HAVING MULTIPLE MODES OF OPERATION

FIELD OF THE INVENTION

The invention relates to a new device for extruding high viscosity fluids and to a mechanism for relieving applied pressure to the fluid material. More specifically, the invention relates to devices having multiple mode operation for extruding high viscosity fluids and a mechanism for relieving pressure applied to the fluid by providing for the "backing up" or rearward movement of the pressure driving means to stop the flow of the fluid.

BACKGROUND OF THE INVENTION

There exist various types of hand-operated fluid and paste material dispensing devices of the caulking gun variety which include a plunger adapted to advance axially through a cylinder to which the end of a paste material cartridge is attached. The plunger is advanced by a trigger-type lever pivoted to a pistol grip, and a ratchet device is mounted to the end of the lever for engaging a rod forming part of the plunger.

Examples of such devices include caulking guns, grease guns, cookie guns, bone cement dispensing guns, and the like. These various fluid extrusion and dispensing devices are disclosed in the patent literature, for example, in U.S. Pat. Nos. 4,994,065; 4,356,938; 1,846,167; 1,672,421 and United Kingdom Patent No. 905,049.

With respect to caulking guns, caulking guns are designed to extrude caulking compound by use of a piston and ratchet-type mechanism. When the amount of the caulking compound desired has been discharged from the caulking gun, forward movement of the piston is stopped, and the piston is held in place by the ratchet mechanism which prevents any backward movement. The caulking compound, being elastic and relatively high viscosity, is in a compressive state and continues to flow out of the caulking gun. The continuing flow of compound frequently creates a mess in addition to being a waste of material.

Most caulking guns have some type of pressure release mechanism. To release the pressure in the typical caulking gun, the gun is equipped with a ratchet bar having teeth along one side only, so that the rod may be turned and rotated about its axis. When the rod is turned, the ratchet teeth are no longer held by the ratchet mechanism and the piston is allowed to move freely backward. This method of relieving the pressure in the caulking gun requires the use of two hands, one to hold the gun, and one to turn the ratchet bar. In most instances, the flow of compound from the caulking gun is not stopped immediately by this method since time is needed to reach and turn the ratchet bar.

In the prior art there are several patents which provide for pressure relief in the caulking gun without having to turn the ratchet bar. They are:

Good U.S. Pat. No. 2,367,347

Peterson 2,530,359

Collins 2,889,085

Subwick 4,126,251

In all of these patents, the pressure relief mechanism is not activated automatically, but requires some action by the operator.

There are also several patents in the prior art which show mechanisms that relieve pressure in the caulking gun without requiring any affirmative action by the operator. These patents are:

Crewe U.S. Pat. No. 2,180,987

Crewe 2,229,839

Crewe 2,233,587

Crewe 2,367,346

All of the prior art patents mentioned immediately above fully relieve the pressure in the caulking gun when the operator releases his grip on the lever, except the Crewe, U.S. Pat. No. 2,233,587 which relieves the pressure in the caulking gun when the lever is fully squeezed. Fully relieving the pressure automatically in a caulking gun results in having to reestablish sufficient pressure to force the caulk out of gun. Thus, the operator will have to squeeze the operating lever many more times to discharge a desired amount of caulk.

SUMMARY OF THE INVENTION

A pressure relief mechanism for use with a caulking gun or similar device is designed to relieve pressure within the gun to a prescribed value. In the preferred embodiment, the caulking gun has a cradle for holding a caulking tube type cartridge with a discharge end having a nozzle, and a drive rod with teeth rigidly attached to a piston for forcing the caulking material out of the tube. A handle is rigidly attached to the open tube with an operating lever. When the operating lever is squeezed, it urges a first dog to engage a tooth of the drive rod and pushes the rod and piston forward. The forward movement of the piston forces caulking compound out of the cartridge.

The multiple mode operation pressure relief mechanism includes a second dog means for engaging the teeth of the drive rod to prevent the rearward movement of the drive rod, the second dog means pivotally attached in the upper handle section and aligned with the pivotal attachment of the first dog means such that both the first and second dog means simultaneously engage the teeth of the drive rod when the lower proximate end of the operating lever is at the further most position from the handle. A release arm is pivotally attached to the operating lever and having sufficient length to disengage the second dog means from engagement with the teeth of the drive rod by the movement of the operating lever to the nearest point with the handle to allow the drive rod to move rearward, at least one position on the teeth and relieve applied pressure of the drive rod and piston.

In accordance with the present invention a caulking gun having multiple modes of operation is provided comprising:

holding means for holding high viscosity fluid for delivery;

a piston for extruding the high viscosity fluid;

a drive rod means having teeth along one longitudinal side of the rod and the drive rod means being attached to the piston and extending through one end of the holding means;

a handle with an upper and lower end fixedly attached to the end of the holding means having the drive rod extending therethrough;

an operating lever with an upper and lower end pivotally attached to a point proximate to the upper ends of the handle and the operating lever;

first biasing means for biasing the lower ends of the handle and operating lever from each other;

first dog means for engaging the teeth of the drive rod means for forward movement of the drive rod means and the piston for extruding the fluid, the first dog means being pivotally attached proximate to the upper end of the operating lever and being biased to engage the teeth of the drive rod means;

second dog means for engaging the teeth of the drive rod means to prevent rearward movement of the drive rod, the second dog means being pivotally attached to the pin;

biasing means for biasing the second dog means to engage the teeth of the drive rod simultaneously with the first dog means when the lower proximate end of the operating lever is at the furthest position from the handle;

release arm means for engaging the second dog means to disengage the second dog means from the teeth of the drive rod to allow the drive rod to move rearward on position on the drive rod teeth resulting in the relief of pressure by the piston.

These and other aspects of the present invention will be appreciated by those skilled in the an upon the reading and understanding of the specification.

BRIEF DESCRIPTION OF THE DRAWINGS

The invention will be further described in connection with the attached drawing figures showing preferred embodiments of the invention including specific parts and arrangements of parts. It is intended that the drawings included as a part of this specification be illustrative of the preferred embodiment of the invention and should in no way be considered as a limitation on the scope of the invention.

DETAILED DESCRIPTION OF THE PREFERRED EMBODIMENTS

Figure 1:
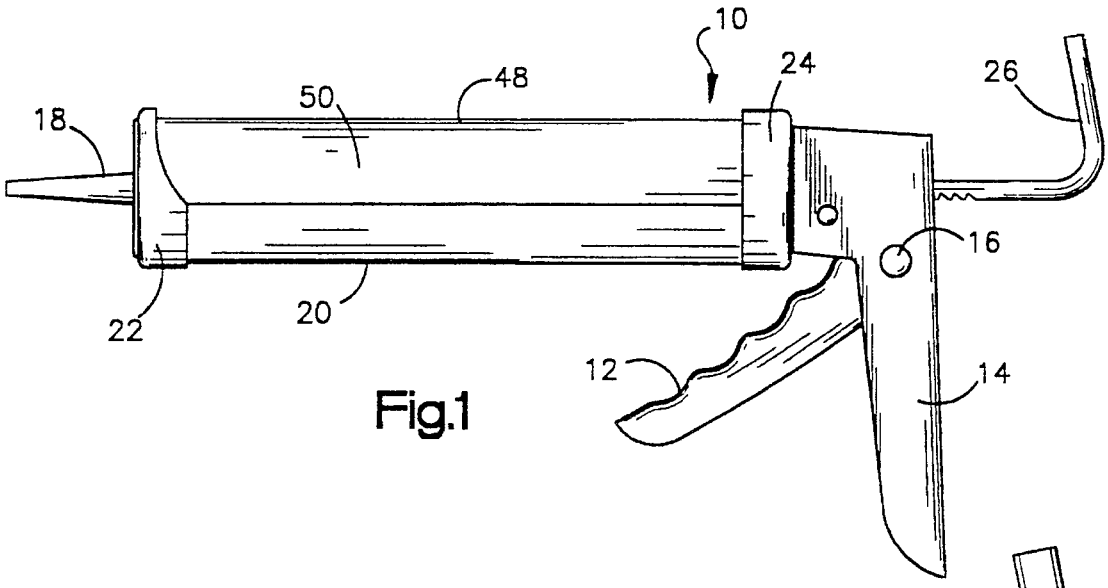
FIG. 1 is a side view of a caulking gun with the pressure relief mechanism of the present invention.

Referring now to the drawings, caulking gun 10 having a pressure relief mechanism of the present invention is illustrated in FIGS. 2, 3, 4, 5 and 6, the pressure relief mechanism relieves the pressure within caulking gun 10 sufficiently to stop the flow of caulking material 50. Caulking gun 10 preferably includes a cradle 20 with end caps 22 and 24 rigidly attached to both ends of the cradle 20. A conventional caulking cartridge 48 with nozzle 18 containing caulking material 50 is securely held in place by the cradle 20 and end caps 22 and 24. While a cradle/cartridge arrangement is shown, the invention contemplates the use of other types of holding means for holding high viscosity fluid for delivery. Such other techniques include a strap/cartridge arrangement or a holding cylinder.

Handle 14 is rigidly attached to end cap 24. Operating lever 12 is pivotally attached to handle 14 at an upper end preferably by bolt 16. Drive rod 26 having teeth 28 along one longitudinal side is coaxially and rigidly attached to a piston (not shown). The piston is designed to coaxially engage a movable backstop of cartridge 48.

Operating lever 12 is biased outwardly preferably by torsion spring 46. Operating lever 12 has first dog 32 pivotally attached to lever 12, preferably by pin 40. First dog 32 is biased by spring 42 to ensure engagement with teeth 28 of drive rod 26. Operating lever 12 is squeezed toward handle 14 as indicated by arrow 52, pivoting about bolt 16 with dog 32 pushing drive rod 26 and the piston forward.

A second dog 34 is pivotally attached by pin 38 and is aligned with pin 40 in order that the second dog 34 and first dog 32 simultaneously engage teeth 28 of the drive rod 26 when the lower proximate end of operating lever 12 is at the furthest point from handle 14. Second dog 34 is biased by spring 44 to ensure the engagement of second dog 34 with teeth 28. Release arm 30 is attached to operating lever 12 at its upper proximate end. The release arm 30 is of sufficient length that upon moving or squeezing operating lever 12 to the nearest position to handle 14, release arm 30 will engage second dog 34 to effect its disengagement from teeth 28 to allow drive rod 26 to move rearward at least one position on teeth 28 upon the release of operating lever 12 and allow the re-engagement of second dog 34 with teeth 28.

Figure 4:
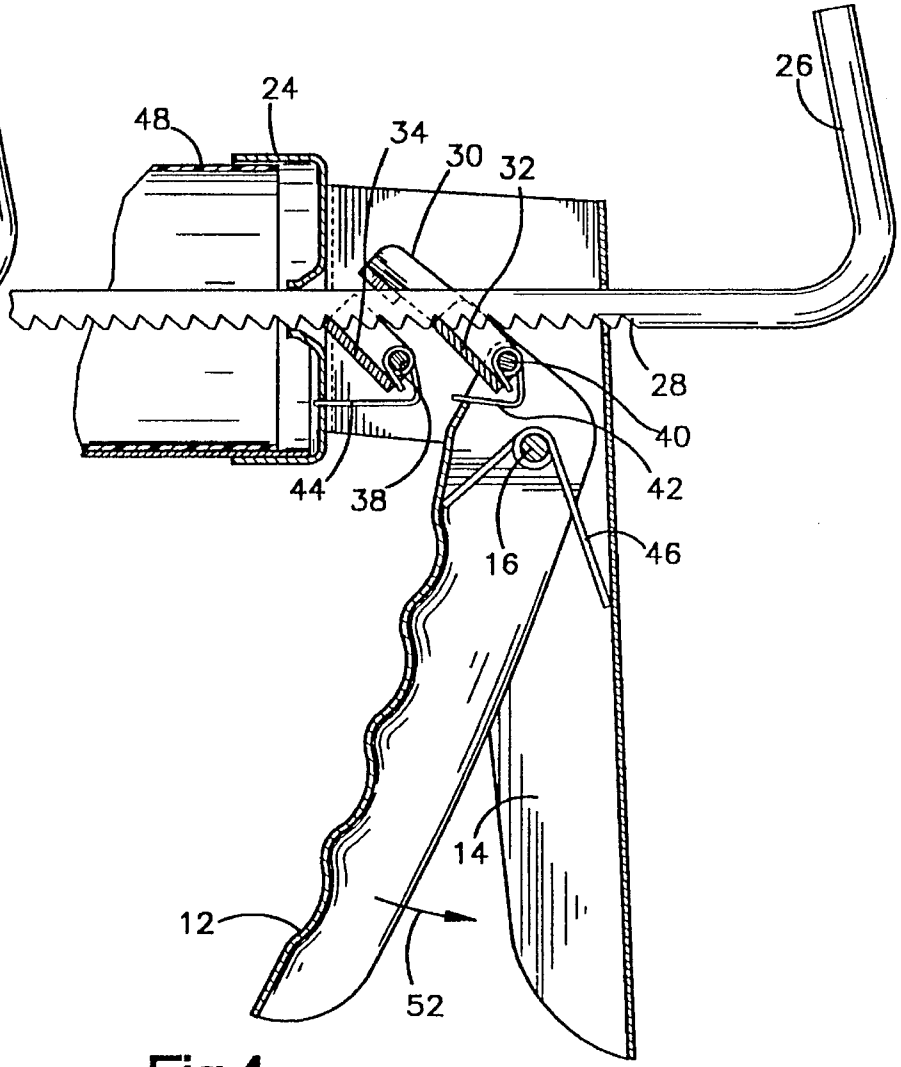
FIG. 4 is an enlarged fragmentary view of the pressure relief mechanism with the drive rod in a forward motion with a partial movement of the operating lever.
Figure 3:
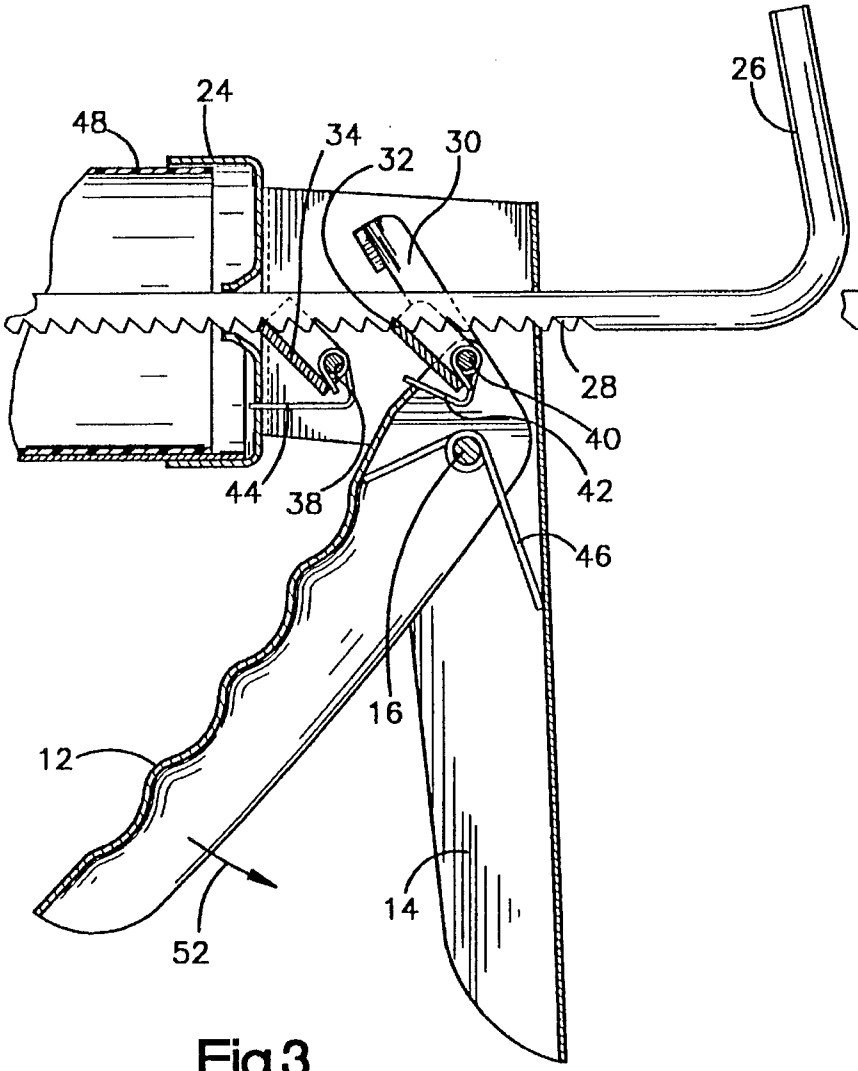
FIG. 3 is an enlarged fragmentary view of the pressure relief mechanism in a start position.
Figure 5:
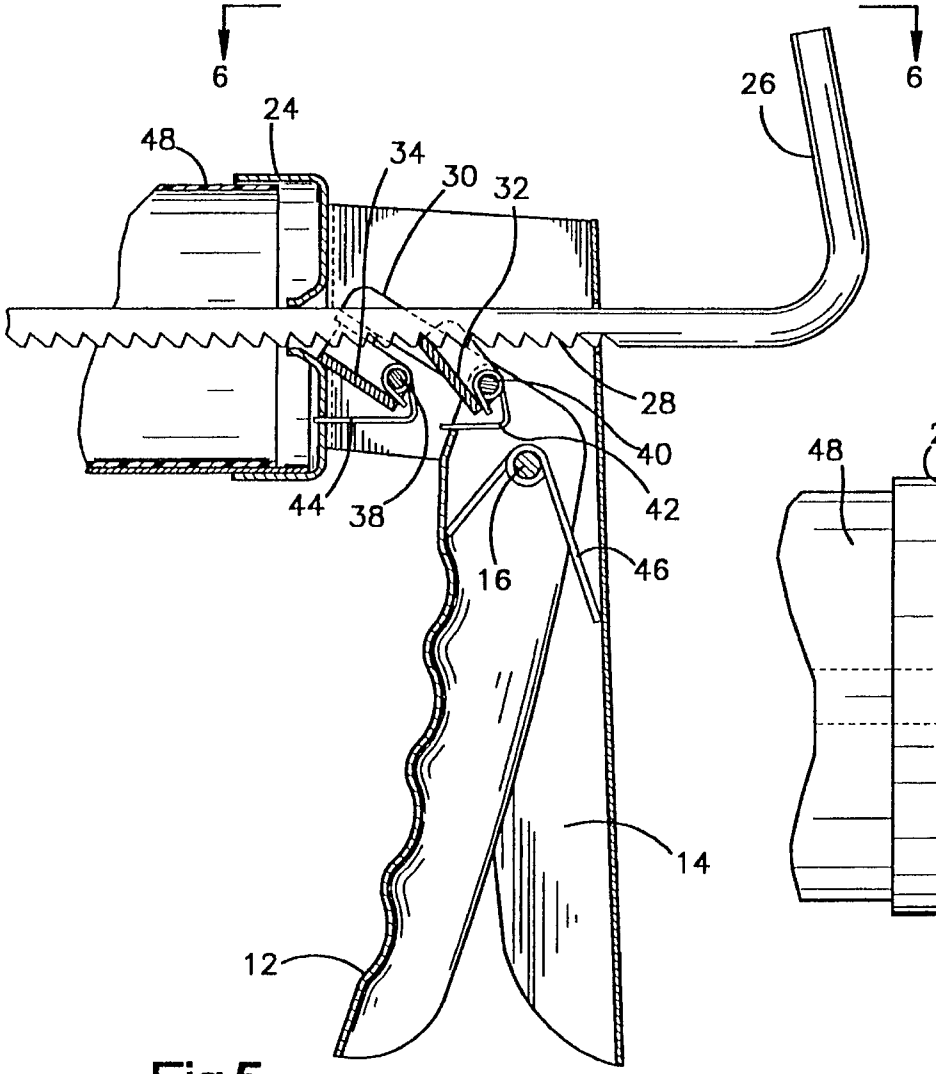
FIG. 5 is an enlarged fragmentary view of the pressure relief mechanism with the drive rod, both dogs, and release arm at their forwardmost positions.

The pressure relief mechanism according to the present invention is further illustrated through one operational cycle as depicted in FIGS. 3–5. The start of the operational cycle is illustrated in FIG. 3. Operating lever 12 is pulled or squeezed towards handle 14 initiating the forward movement of drive rod 26. As illustrated in FIG. 4, as the operating lever 12 moves toward handle 14, release arm 30 is moving forward and down to engage second dog 34. All the while, drive rod 26 is being moved forward and any rearward movement of the drive rod 26 is prevented by second dog 34 engaging teeth 28.

Figure 2:
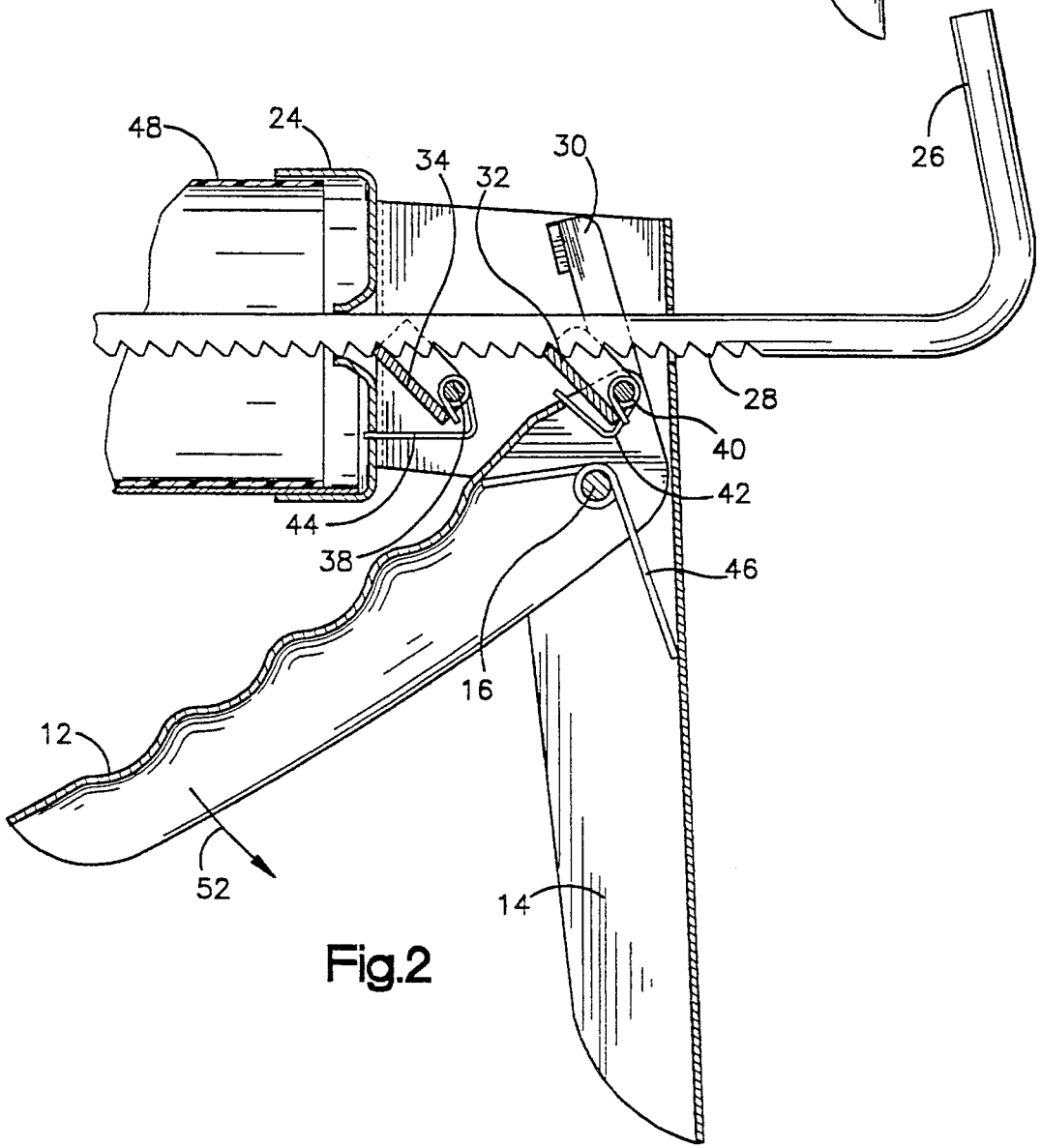
FIG. 2 is an enlarged cross-sectional side view of a section of the caulking gun with the pressure relief mechanism with some portions shown whole for purposes of clarity.

Upon operating lever 26 reaching the end of its travel toward handle 14, i.e., operating lever 12 is squeezed to the nearest position to handle 14, as shown in FIG. 5, release arm 30 engages second dog 34 to effect its disengagement from teeth 28 on drive rod 26, allowing drive rod 26 to retreat or move backward at least one position on teeth 28. As a result of this final stage of the operational cycle, pressure on the fluid 50 in cartridge 48 is relieved and will stop or cut off the flow of the fluid 50 through nozzle 18. Upon releasing operating lever 12, release arm 30 will disengage second dog 34 allowing second dog 34 to re-engage teeth 28 on drive rod 26, stopping any further rearward movement of drive rod 26 to its starting position or stage as illustrated in FIG. 2.

Figure 6:
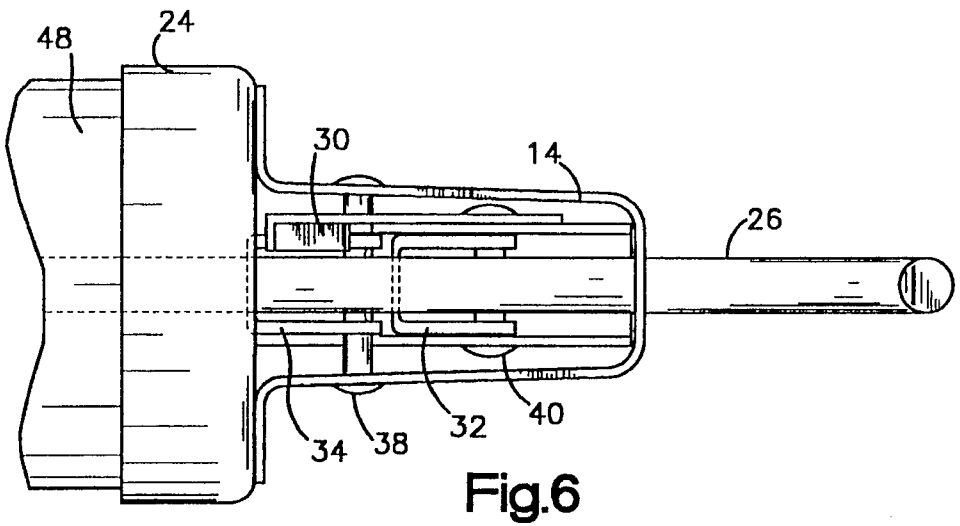
FIG. 6 is an enlarged fragmentary top view of the pressure relief mechanism.

FIG. 6 illustrates a top view of the entire pressure release mechanism according to the present invention. As shown, release arm 30 moves forward and down toward second dog 34 as operating lever 12 (not shown in this figure) travels toward handle 14 effecting the movement of drive rod 26 forward by the forward movement of first dog 32.

As previously mentioned, the pressure relief mechanism according to the present invention has at least two modes of operation which allows for more controlled delivery of the caulking material 50 and/or fluid material being applied. In the first mode of operation, the operating lever 12 is pulled or squeezed in one continuous motion toward handle 14 wherein first dog 32 moves drive rod 26 forward at least two positions on teeth 28 which may be indicated audibly by two "clicks" of second dog 34. At the end of the travel of operating lever 12 toward handle 14, i.e., operating lever 12 is fully squeezed and at the nearest point to handle 14, release arm 30 engages second dog 34 to disengage dog 34 from teeth 28, allowing first dog 32 and any back pressure to effect the movement of drive rod 26 rearward until release arm 30 disengages second dog 34 upon the release of operating lever 12 and resulting in second dog 34 re-engaging teeth 28 at least one position on the teeth backward or rearward. Thus, this operating cycle or mode results in drive rod 26 moving forward at least two positions on teeth 28 and retreating or moving backward at least one position on teeth 28.

A second mode of operation is effected by pulling or squeezing operating lever 12 to a position approximately one half the distance to handle 14. This position as illustrated in FIG. 4 will result in the drive rod 26 moving forward at least one position on teeth 28 as indicated audibly by one "click" of second dog 34 and provides for sustained but lower pressure near the end of the extrusion of the fluid or caulking material 50 with no pressure release at this point. This mode of operation or cycle may be completed by pulling or squeezing the operating lever 12, now at a position approximately one-half the distance to handle 14, to the fully squeezed position or the remaining one half distance as illustrated in FIG. 5. At this second stage of mode two, drive rod 26 will move forward at least one position on the teeth 28 as indicated audibly by one "click" of second dog 34 and at the end of the travel of operating lever 12 release arm 30 will engage second dog 34 releasing or disengaging dog 34 from teeth 28 and allowing drive rod 26 to retreat or move backward at least one position on the teeth 28 by the indication audibly of one "click" as the operating lever 12 is released causing release arm 30 to disengage second dog 34 and second dog 34 re-engaging with teeth 28 at one position rearward on teeth 28.

The pressure relief mechanism described in the preferred embodiment above, provides a mechanism for caulking guns and similar types devices, i.e., cookie guns, grease guns, bone cement, dispensing guns and the like, for the more controlled delivery and application of the fluid material being applied as well as reducing waste of the fluid material by stopping it at the end of application as opposed to some residual material continuing to extrude through the nozzle after application. Moreover, the pressure relief mechanism according to the present invention not only allows for this multi-mode, more controlled delivery system, but also relieves pressure automatically to provide "one hand" operation. In other words, the operator does not have to activate the pressure relief mechanism by a secondary motion as described in the background of the invention. In addition, the design of this mechanism provides for relatively simple and economic manufacture of the mechanism as well as providing highly reliable and durable mechanism for long time use.

It will be recognized that various alternatives to the above discussed preferred embodiment may be employed. For example, the release arm 30 may be oriented or affixed to operating lever 12 below the plane of drive rod 26 as opposed to above the plane of drive rod 26 in a fully released position as illustrated in FIG. 2.

Thus, while the preferred embodiment of the invention has been fully described and illustrated in detail above with reference to a specific preferred embodiment, it will be evident that various changes and modifications may be made to this preferred embodiment without departing from the scope or spirit of the invention. It is intended, therefore, that the invention will be limited only by the scope of the claims which follow.

We claim:

1. A multiple operational pressure relief mechanism for use with a high viscosity fluid delivery device having a drive rod with teeth along one longitudinal side of said rod, said rod attached to a piston for extruding said fluid, a handle including an operating lever pivotally attached at a point proximate to the upper ends of the handle and the operating lever, biasing means for maintaining the lower end of the operating lever and the handle away from one another, and a first dog means pivotally attached to the operating lever proximate to the upper end of the operating lever and biased to continuously engage the teeth of the drive rod to effect the forward movement of the drive rod and piston as the lower end of the operating handle is moved toward the handle, the pressure relief mechanism comprising:

a second dog means for engaging the teeth of the drive rod to prevent the rearward movement of the drive rod, the second dog means pivotally attached in the upper handle section and aligned with the pivotal attachment of the first dog means such that both the first and second dog means simultaneously engage the teeth of the drive rod when the lower end of the operating lever is at the farthest position from the handle; and a release arm fixedly attached to the operating lever and having sufficient length to contact the second dog means upon movement of the operating lever to the nearest position to the handle to cause the second dog means to disengage the teeth of the drive rod.

2. The mechanism according to claim 1 wherein the first and second dog means further include first and second biasing means for maintaining the first and second dog means engaged with the drive rod teeth when the lower end of the operating lever is at the furthest position from the handle.

3. The mechanism according to claim 1 wherein the release arm is disposed relative to the operating lever such that the end of the release arm remote from the attachment to the operating lever is above the plane of the drive rod when the lower end of the operating lever is at the furthest position from the handle.

4. The mechanism according to claim 1 wherein a first, pressure relief mode of operation involves moving the operating lever to its nearest position to the handle to result in the drive rod first moving forward at least two positions on the teeth followed by the drive rod moving rearward at least one position on the teeth of the drive rod upon the complete release of the operating lever and a second, non-pressure relief mode of operation involves moving the operating lever approximately one half the distance to the handle to advance the drive rod forward one position on the teeth without a rearward movement of the drive rod upon the release of the operating lever.

5. A caulking gun having multiple modes of operation comprising:

holding tube means for holding high viscosity fluid for delivery;

a piston for extruding a high viscosity fluid;

a drive rod means having teeth along one longitudinal side of the rod and the drive rod means being attached to the piston and extending through one end of the holding means;

a handle with an upper and lower end fixedly attached to the end of the holding means having the drive rod extending therethrough;

an operating lever with an upper and lower end pivotally attached to a point proximate to the upper ends of the handle and the operating lever;

first biasing means for biasing the lower ends of the handle and operating lever from each other;

first dog means for continuously engaging the teeth of the drive rod means for forward movement of the drive rod means and the piston for extruding the fluid, the first dog means being pivotally attached proximate to the upper end of the operating lever and being biased to engage the teeth of the drive rod means;

second dog means for engaging the teeth of the drive rod means to prevent rearward movement of the drive rod, the second dog means being pivotally attached to the handle;

biasing means for biasing the second dog means to engage the teeth of the drive rod simultaneously with the first dog means when the lower proximate end of the operating lever is at the furthest position from the handle;

release arm means for contacting the second dog means to disengage the second dog means from the teeth of the drive rod to allow the drive rod to move rearward one position of the drive rod teeth resulting in the partial relief of pressure by the piston.

6. The caulking gun according to claim 5 wherein said release arm is fixedly attached to the operating lever and is disposed relative to the operating lever such that the end of the arm remote from the attachment to the operating lever extends above the plane of the drive rod means when the lower end of the operating lever is at the furthest position from the handle.

7. The caulking gun according to claim 6 wherein a first, pressure relief mode of operation involves moving the operating lever to its nearest position to the handle to result in the drive rod first moving forward at least two positions on the teeth followed by the drive rod moving rearward at least one position on the teeth upon the release of the operating lever and a second, non-pressure relief mode of operation involves moving the operating lever approximately one half the distance to the handle to advance the drive rod forward at least one position on the teeth without a rearward movement of the drive rod upon the release of the operating lever.

8. The caulking gun according to claim 5 wherein the holding means is selected from the group consisting of a cradle, straps, and a cylinder.

* * * * *